US009333768B2

(12) United States Patent
Edlitz et al.

(10) Patent No.: US 9,333,768 B2
(45) Date of Patent: May 10, 2016

(54) PRINTED INK CURING

(71) Applicant: HEWLETT-PACKARD INDUSTRIAL PRINTING LTD., Netanya (IL)

(72) Inventors: Yokai Edlitz, Netanya (IL); Ran Vilk, Qiryat Ono (IL); Gilad Ben-Bassat, Kfar Yona (IL)

(73) Assignee: Hewlett-Packard Industrial Printing LTD, Netanya (IL)

( * ) Notice: Subject to any disclaimer, the term of this patent is extended or adjusted under 35 U.S.C. 154(b) by 0 days.

(21) Appl. No.: 14/435,983

(22) PCT Filed: Oct. 22, 2012

(86) PCT No.: PCT/IL2012/050416
§ 371 (c)(1),
(2) Date: Apr. 15, 2015

(87) PCT Pub. No.: WO2014/064672
PCT Pub. Date: May 1, 2014

(65) Prior Publication Data
US 2015/0283830 A1 Oct. 8, 2015

(51) Int. Cl.
*B41J 11/00* (2006.01)

(52) U.S. Cl.
CPC ..... *B41J 11/0015* (2013.01); *B41J 11/002* (2013.01)

(58) Field of Classification Search
CPC .. B41J 11/002; B41J 11/0005; B41J 11/0015; B41M 7/0081; C09D 11/101; C09D 11/30
See application file for complete search history.

(56) References Cited

U.S. PATENT DOCUMENTS 8,105,659 B2 * 1/2012 Chretien ..... B41M 7/0081 106/31.13
2012/0154495 A1 6/2012 Edwards

OTHER PUBLICATIONS

International Search Report for PCT/IL2012050416 dated Jul. 30, 2013, 4 pp.

* cited by examiner

*Primary Examiner* — Thinh Nguyen
(74) *Attorney, Agent, or Firm* — HP Inc Patent Department

(57) ABSTRACT

An ink-jet printing system (10) includes a generator (20) for in situ generation of a component of an inert atmosphere (an atmosphere that is depleted of oxygen). The system also includes a curing zone (16) in which the generated component (for example nitrogen or carbon dioxide) is distributable over ink that had been deposited on a substrate (12), and in which the ink is exposable to a curing agent (for example UV radiation).

13 Claims, 3 Drawing Sheets

PRINTED INK CURING

BACKGROUND

Curable inks, and in particular ultraviolet-curable inks, may, in some situations, provide advantages over other types of inks. Ultraviolet-curable inks may enable rapid and precise printing on a wide variety of substrates or media. The substrates may include flexible or rigid substrates. The substrates may have porous or impermeable surfaces. Use of ultraviolet-curable inks instead of solvent-based inks may reduce the amount of volatile organic compounds that are released during printing, thus reducing or eliminating requirements for ventilation. Curing of ultraviolet-curable inks may be more rapid than drying of solvent-based inks. Ultraviolet-curable inks generally have a low viscosity and do not penetrate into the substrate. Therefore, printing with ultraviolet-curable ink may entail using a much smaller quantity of ink than would printing a similar area with solvent-based ink.

DETAILED DESCRIPTION

Figure 1:
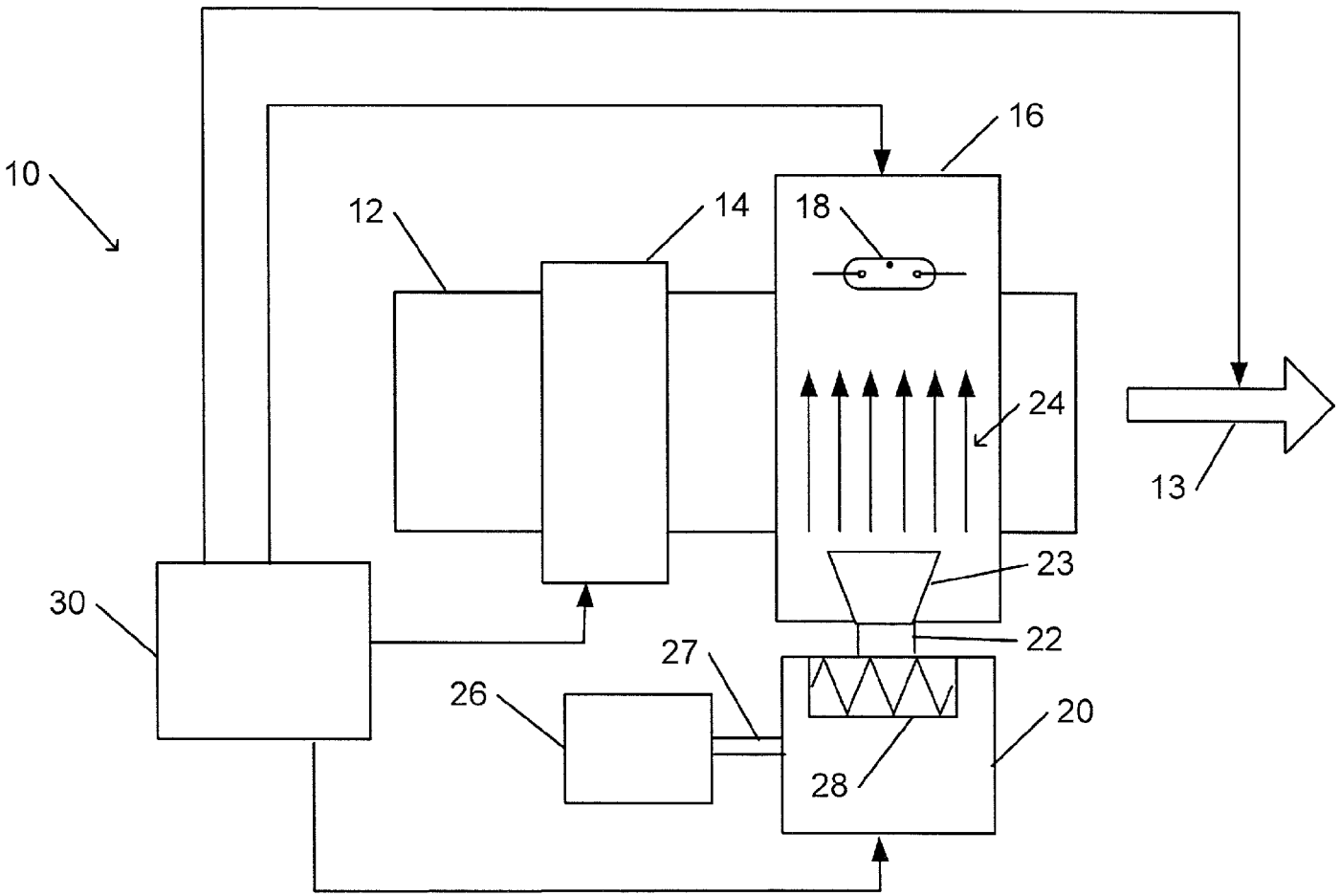
FIG. 1 is a schematic illustration of an example of a printing system for application of an example of printed ink curing.

Printing with curable ink includes a curing step. In the curing step, ink that was deposited on the substrate is exposed to a curing agent. For example, when printing with an ultraviolet-curable ink, curing includes exposure to ultraviolet radiation. The curing causes polymerization of components of the ink. The cured ink may then be enduringly bound to the substrate.

A region of a printing system in which curing of deposited ink takes place may be referred to as a curing zone of the system. For example, a section of a substrate on which ink was deposited during a printing step may be transported to a curing zone of the system for curing of the deposited ink.

Oxygen molecules reacting with the deposited ink may interfere with polymerization of the ink.

In accordance with an example of a process for curing of ink deposited during printing, an inert atmosphere is generated for introduction into a curing zone of a printing system. The inert atmosphere is introduced to cover ink that is deposited on a substrate during a printing step (e.g. inkjet printing). For example, the deposited ink may include one or more ultraviolet-curable components. The ink that is covered by the inert atmosphere is cured by exposure to a curing agent, such as ultraviolet light. The curing zone may be partially or fully enclosed within a curing chamber.

An inert atmosphere, as referred to herein, is an atmosphere that is depleted of oxygen. Examples of gases that are suitable components of an inert atmosphere include an inert gas, nitrogen, water vapor, carbon dioxide, or another gas that does not interact with deposited ink and that does not include oxygen ($O_2$) molecules. The inert atmosphere may prevent oxygen ($O_2$) from the ambient atmosphere from diffusing into the deposited ink. Prevention of diffusion of atmospheric oxygen into the deposited ink may reduce or eliminate any inhibition of polymerization of the curable components that is caused by diffused oxygen. By reducing or eliminating the diffusion of atmospheric oxygen into the deposited ink, the deposited ink may be cured using less energy (e.g. in the form of ultraviolet radiation) than would be required without reduction of oxygen diffusion.

In accordance with an example of printed ink curing, the inert atmosphere is generated in situ. In situ generation refers herein to production of a gaseous component of the inert atmosphere from other materials, e.g. via a chemical reaction or via extraction from another material (e.g. ambient air, or from a provided fluid or liquid).

In situ generation of the inert atmosphere may enable maintaining a substantially uniform inert atmosphere throughout the curing process. Maintaining a substantially uniform inert atmosphere includes replenishing components of the inert atmosphere to replace any gaseous components that may flow or diffuse out of the curing zone.

For example, a component of an inert atmosphere may be generated in situ by operating a chemical generator. The generator may include a reaction chamber in which a suitable chemical reaction takes place to produce a component of the inert atmosphere. The generator may include an extraction device in which a component of the inert atmosphere is extracted from a mixture of components.

The generator may include a combustion chamber. Combustion of a flammable gas in a combustion chamber may generate one or more combustion products that may be utilized as components of an inert atmosphere. In addition, the combustion may generate heat that may be utilized to expedite the curing process. For example, heat that is generated by the combustion may be utilized to evaporate water or other components from the deposited ink.

For example, combustion of propane ($C_3H_8$) gas may produce water vapor, carbon dioxide, and heat via a reaction:

$$C_3H_8+5O_2 \rightarrow 3CO_2+4H_2O+\text{heat}.$$

As another example, combustion of butane ($C_4H_{10}$) gas may produce water vapor, carbon dioxide, and heat via a reaction:

$$2C_4H_{10}+13O_2 \rightarrow 8CO_2+10H_2O+\text{heat}.$$

In situ generation of an inert atmosphere may be advantageous. For example, in situ generation of the inert atmosphere may enable efficient and relatively inexpensive maintenance of a substantially constant oxygen-depleted layer over the deposited ink. The inert atmosphere may be generated using a simple combustion chamber of a readily available gas such as butane or propane. The combustion chamber may provide heat that may be further utilized in evaporating water from the deposited ink.

In particular, examples of situ generation of an inert atmosphere may be advantageous when printing with an ultraviolet-curable ink that is water based (e.g. includes water as a solvent). In this case, a combustion product or otherwise heated component of an inert atmosphere may be introduced over the deposited ink. Introducing a heated component of the inert atmosphere may thus concurrently promote evaporation of the water as well as providing an oxygen-depleted layer over the ink so as to enable efficient ultraviolet curing of the ultraviolet-curable components of the ink. For example, separation of water vapor from one or more other heated generated components of the atmosphere may promote evaporation of water from the ink.

On the other hand, providing components of the inert atmosphere from a tank or similar container (without in situ generation) could require constant replenishing of the gas, leading to constant maintenance and resupply. Similarly, depleting oxygen from the vicinity of the deposited ink by maintaining a vacuum could require using a large amount of electrical or other energy.

FIG. 1 is a schematic illustration of an example of a printing system for application of an example of printed ink curing. Printing system 10 is configured to print on a substrate 12.

During a printing process, substrate 12 is transported relative to one or more components of printing system 10. For example, substrate 12 may be transported by an appropriate transport system or mechanism, e.g. with a motion in a direction indicated by arrow 13 (henceforth, motion 13). Motion 13 may represent a linear translational motion, a rotational motion (e.g. turning or a non-linear translation, e.g. about a cylinder), or another motion of substrate 12. Substrate 12 may be transported by one or more moving platforms, conveyor belts, rollers, non-contact transport systems (e.g. based on flow of air or another fluid, or based on electromagnetic levitation), mechanical arms, or similar transport systems. Equivalently, one or more components of printing system 10 may be moved (e.g. translated) relative to substrate 12, or both components of printing system 10 and substrate 12 may be moved concurrently or successively.

Motion 13 or operation of one or more components of a transportation system of printing system 10 may be controlled by a controller 30.

Substrate 12 may include a sheet or object that is made of any material which may be printed on. Suitable materials may include, for example, paper, cardboard, wood, plastics, textiles, or metals. Substrate 12 may be flat or may be shaped in another manner (e.g. curved). Printing system 10 may be configured to print only on a substrate 12 whose size, shape, weight, or other property corresponds to a predetermined set of substrate properties.

Ink (or another deposited material, any such material being herein referred to as ink) may be deposited on substrate 12 by printhead 14. Printhead 14 may include one or more nozzles or similar ink dispensing components that are configured to dispense ink on substrate 12. Printhead 14 may include one or more separate printhead units. For example, each separate printhead unit may be configured to dispense a particular type (e.g. each particular type being characterized by a particular color, texture, or other property) of ink. Such separate printhead units may be operable separately from one another, or may be operable in a coordinated fashion.

Printhead 14 may include, or be connected to, one or more ink containers. For example, each of several ink containers may include a different type of ink. Each container may be refillable or replaceable.

Printhead 14 may be controlled so as to deposit ink on substrate 12 in accordance with programmed instructions. For example, a controller 30 that is operating in accordance with a driver application file may control printhead 14 in accordance with a content file. The content file may include a digital representation of an image or text that is to be printed on substrate 12.

The deposited ink may include colorants (e.g. pigments and colorants) and other components that facilitate deposition or curing of the ink. The ink includes a carrier component that serves to facilitate delivery of the colorants to the surface of substrate 12. The carrier may include a photo-initiator component that, when exposed to ultraviolet light, initiates polymerization of one or more liquid monomer components. The ink may include one or more water-based or organic solvents.

A region of substrate 12 on which ink was deposited by printhead 14 may be transported to curing zone 16 for curing. Curing zone 16 may include a plurality of separate curing sub-units. Each of the curing sub-units may have a separate function (e.g. providing curing radiation of different wavelengths, providing different curing agents), or may have identical function to one another. For example, one curing sub-unit may provide heat, one may provide an inert atmosphere, and one may provide ultraviolet curing radiation. As another example, one curing sub-unit may provide initial curing to fix or pin a printed image (e.g. to prevent dispersion of ink during subsequent steps of stages), while another may complete the curing.

Part or all of curing zone 16 may be completely or partially enclosed in one or more curing chambers. Each curing chamber may have identical or different functions. For example, each curing chamber may enclose a different curing sub-unit.

Although printhead 14 and curing zone 16 are depicted in FIG. 1 as separate structures, printhead 14 and curing zone 16 may be enclosed in a single housing. Components of printhead 14 and curing zone 16 may be arranged such that the components of printhead 14 and curing zone 16 are interspersed among one another. For example, printhead 14 may include a plurality of printhead units. Each of the printhead units may be associated with a separate curing subunit. For example, a region of a substrate that is being transported as indicated by arrow 13 may successively pass a first printhead unit, a first curing subunit, a second printhead unit, a second curing subunit, and so on.

Curing zone 16 includes one or more units or devices for creation or generation of a curing agent. The curing agent is applied to ink that had been previously deposited on substrate 12 by printhead 14.

Curing zone 16 may include a lamp 18. Lamp 18 includes one or more radiation generation units for generating a curing radiation. For example, the curing radiation may include radiation in one or more ultraviolet bands. In this case, lamp 18 may include one or more lamps that produce ultraviolet radiation. For example, lamp 18 may include an appropriate xenon or mercury discharge lamp.

Curing zone 16 is associated with combustion chamber 20. In combustion chamber 20, a combustible material may be burned. The combustible material or other material required for combustion (e.g. oxygen) may be provided by a container 26. Container 26 may include one or more separate tanks or other containers for containing one or more components of the combustible material. Container 26 may include a tank for containing a gaseous component of the combustible material in compressed form. Container 26 may contain a volatile or other liquid component of the combustible material. Container 26 may include a powdered or other solid component of the combustible material. For example, the combustible material that is provided by container 26 may include propane or butane.

Sufficient oxygen may be provided (e.g. from container 26 or another source) may be provided to enable complete combustion of the combustible material. After complete combustion, the combustion products include only carbon dioxide and water vapor, with at most trace amounts of complex organic molecules.

One or more components of the combustible material may be conveyed from container 26 to combustion chamber 20 via material conduit 27. For example, material conduit 27 may include a tube or pipe that is suitable for conveying one or more components of the combustible material. Conduit 27 may include a flow control device in the form of a pump, valve, filter, or other device that may be operated to control the flow of one or more components of the combustible material through conduit 27. The flow control device may be operated automatically by a controller that is associated with printing system 10, may be operated manually (e.g. remotely) by an operator of printing system 10, or by a combination of automatic and manual controlling.

The combustible material may be combusted or burned in combustion chamber 20. For example, a combustible gaseous material (e.g. gas, liquid, or solid) may be provided with oxygen (or other suitable gas) so as to enable combustion. The oxygen may be provided from the ambient atmosphere (e.g. via an intake vent or opening), or may be provided from a suitable tank or container, such as container 26.

Combustion in combustion chamber 20 may be initiated spontaneously (e.g. upon exposure of the combustible material to oxygen), or may be initiated using a suitable combustion initiation mechanism. For example, a combustion initiation mechanism may include generation of a spark, exposure to a heated element (e.g. resistance wire), radiation (e.g. focused light or other electromagnetic radiation), exposure to a catalyst, or another suitable mechanism for initiating combustion.

Combustion chamber 20 may include a heat exchanger 28. Heat exchanger 28 may be configured to heat a stream of a gas. The heated stream of gas may include a component of inert atmosphere 24 that is to be heated and conducted to curing zone 16, or may include a stream of another gas that is to be heated. For example, the heated stream of gas may be directed to curing zone 16 so as to enable heating or drying of ink that had been deposited on substrate 12. The heated stream of gas may be included within, or otherwise applied concurrently with, inert atmosphere 24. In other cases, the heated stream of gas may be directed toward substrate 12 separately from (e.g. in a different subunit of curing zone 16, or at a separate time from) application of inert atmosphere 24.

Operation of one or more components of combustion chamber 20 may be controlled by controller 30.

Combustion of the combustible material in combustion chamber 20 may yield one or more combustion products. For example, the combustion products may include a gaseous combustion product such as carbon dioxide gas or water vapor. One or more of the combustion products may be suitable for inclusion in an inert atmosphere 24 in curing zone 16.

Inert atmosphere 24 includes one or more combustion products that are produced in combustion chamber 20. A component of inert atmosphere 24 may be conveyed from combustion chamber 20 to curing zone 16 via combustion product conduit 22.

Combustion product conduit 22 may include one or more tubes or pipes that are suitable for conducting a gaseous combustion product from combustion chamber 20 to curing zone 16. Combustion product conduit 22 may include a blower, fan, pump, or other device for facilitating transport of a gaseous combustion product from combustion chamber 20 to curing zone 16.

Combustion product conduit 22 may include one or more separation devices or units for separating a combustion product that is formed in combustion chamber 20 from one or more other combustion products. For example, a separation device may include a semi-permeable membrane that enables one combustion product to pass while blocking another. A separation device may be based on inertia (e.g. centrifugal force) or other mechanical effects, adsorption or absorption, electromagnetic separation, thermal properties, chemical or molecular forces, or on other properties, forces, reactions, or phenomena.

One or more of the separated combustion products may be conveyed to form a component of inert atmosphere 24 in curing zone 16. In accordance with some examples of printed ink curing, two or more separated combustion products may be conveyed concurrently to curing zone 16. In this case, inert atmosphere 24 may include a plurality of gaseous components. In other examples of printed ink curing, two or more separated combustion products may be conveyed provided separately to curing zone 16. For example, each separated component may be conveyed to a separate subunit of curing zone 16, or may be provided at different times to a single subunit of curing zone 16.

Curing zone 16 may be provided with an atmosphere distribution unit 23 for forming inert atmosphere 24. Atmosphere distribution unit 23 may include an arrangement of one or more conduits, tubes, pipes, nozzles, or openings for distributing components of inert atmosphere 24 within curing zone 16. For example, atmosphere distribution unit 23 may be configured to distribute components of inert atmosphere 24 so as to form a layer of oxygen-depleted gas. The formed layer of oxygen-depleted gas may cover ink that had been previously deposited on substrate 12 by printhead 14. Atmosphere distribution unit 23 may be configured to introduce additional components into inert atmosphere 24, e.g. in addition to combustion products that were produced by combustion in combustion chamber 20. For example, one or more additional components may be extracted from the ambient atmosphere or from a tank or similar container.

Atmosphere distribution unit 23 may be configured to, or may include a component that is configured to, direct heated gas (e.g. a component of inert atmosphere 24, air, or another gas) toward substrate 12.

Atmosphere distribution unit 23 may include a mechanism or system for recycling one or more components of inert atmosphere 24. Atmosphere distribution unit 23 may include an air knife mechanism or similar mechanism to inhibit outflow of components of inert atmosphere 24 from a region of curing zone 16 in which a curing agent is applied. Such a mechanism for inhibiting outflow may enable reducing the quantity of combustible material that is required for formation of inert atmosphere 24.

Atmosphere distribution unit 23 may include, or cooperate with, one or more sensors for monitoring a current state of inert atmosphere 24. For example, a sensor may be configured to sense a current quantity (e.g. density) of one or more components of inert atmosphere 24. A sensor may be configured to sense a temperature, flow rate, pressure, humidity or dryness, or other property of inert atmosphere 24 or of a component of inert atmosphere 24.

Operation of atmosphere distribution unit 23, of lamp 18, or of one or more other components of curing zone 16 may be controlled by controller 30.

For example, a flow of carbon dioxide at a flow rate of about 1.5 liters per second to about 3.0 liters per second has been experimentally found to be sufficient to enable complete curing of a layer of deposited ink.

For example, butane may be provided (e.g. from container 26) to combustion chamber 20 at a rate of about 0.035 moles per second (corresponding to about 2 grams per second) to produce carbon dioxide at a rate of about 0.14 moles per second (corresponding to a production rate of about 6.28 grams per second of carbon dioxide). This production rate corresponds approximately to a flow rate of 1.6 liters per second of carbon dioxide gas at a temperature of about 180° C. On the assumption of continuous consumption of butane at the aforementioned rate, monthly consumption of butane may be approximately 5000 kilograms. The cost of 5000 kilograms of butane per month may be comparable to, or may be less than, the additional monthly cost that would be required to provide electricity for ultraviolet curing in the absence of a generated inert atmosphere. Similarly, the cost of 5000 kilograms of butane per month may be comparable to, or may be less than, the additional monthly cost that would be required to provide components of an inert atmosphere in the absence of in situ generated components of the inert atmosphere (e.g. the components, such as carbon dioxide, being either purchased or extracted from the ambient air).

Figure 2:
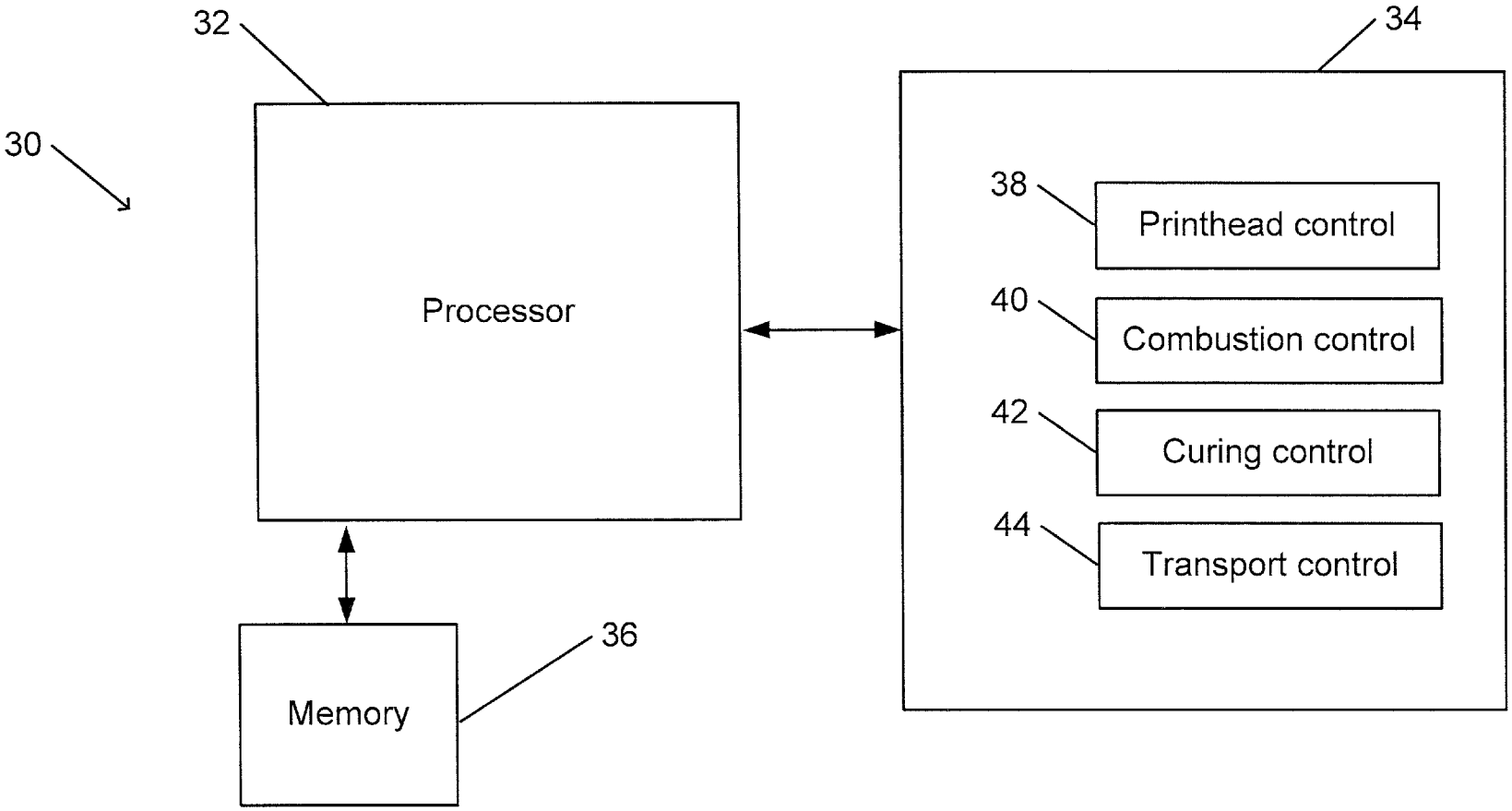
FIG. 2 is a schematic illustration of an example of a controller for a printing system such as the printing system shown in FIG. 1.

FIG. 2 is a schematic illustration of an example of a controller for a printing system such as the printing system shown in FIG. 1.

Controller 30 includes a processor 32. For example, processor 32 may include one or more processing units, e.g. of one or more computers. Some or all components of processor 32 may be incorporated in a printer of printing system 10, or of a computer that is associated with printing system 10. Processor 32 may be configured to operate in accordance with programmed instructions stored in memory 36. Processor 32 may be capable of executing an application for controlling a system printed ink curing.

Processor 32 may communicate with memory 36. Memory 36 may include one or more volatile or nonvolatile memory devices. Memory 36 may be utilized to store, for example, programmed instructions for operation of processor 32, data or parameters for use by processor 32 during operation, or results of operation of processor 32

Processor 32 may communicate with data storage device 34. Data storage device 34 may include one or more fixed or removable nonvolatile data storage devices. For example, data storage device 34 may include a computer readable medium for storing program instructions for operation of processor 32. In this example, the programmed instructions may take the form of printhead control module 38 for controlling operation of printhead 14, combustion control module 40 for controlling operation of combustion chamber 20, curing control module 42 for controlling operation of one or more components of curing zone 16, or transport control module 44 for controlling motion 13. It is noted that data storage device 34 may be remote from processor 32. In such cases data storage device 34 may be a storage device of a remote server storing printhead control module 38, combustion control module 40, curing control module 42, or transport control module 44 in the form of an installation package or packages that can be downloaded and installed for execution by processor 32. Data storage device 34 may be utilized to store data or parameters for use by processor 32 during operation, or results of operation of processor 32.

In operation, processor 32 may execute a method for controlling a printing system for application of an example of printed ink curing.

Figure 3:
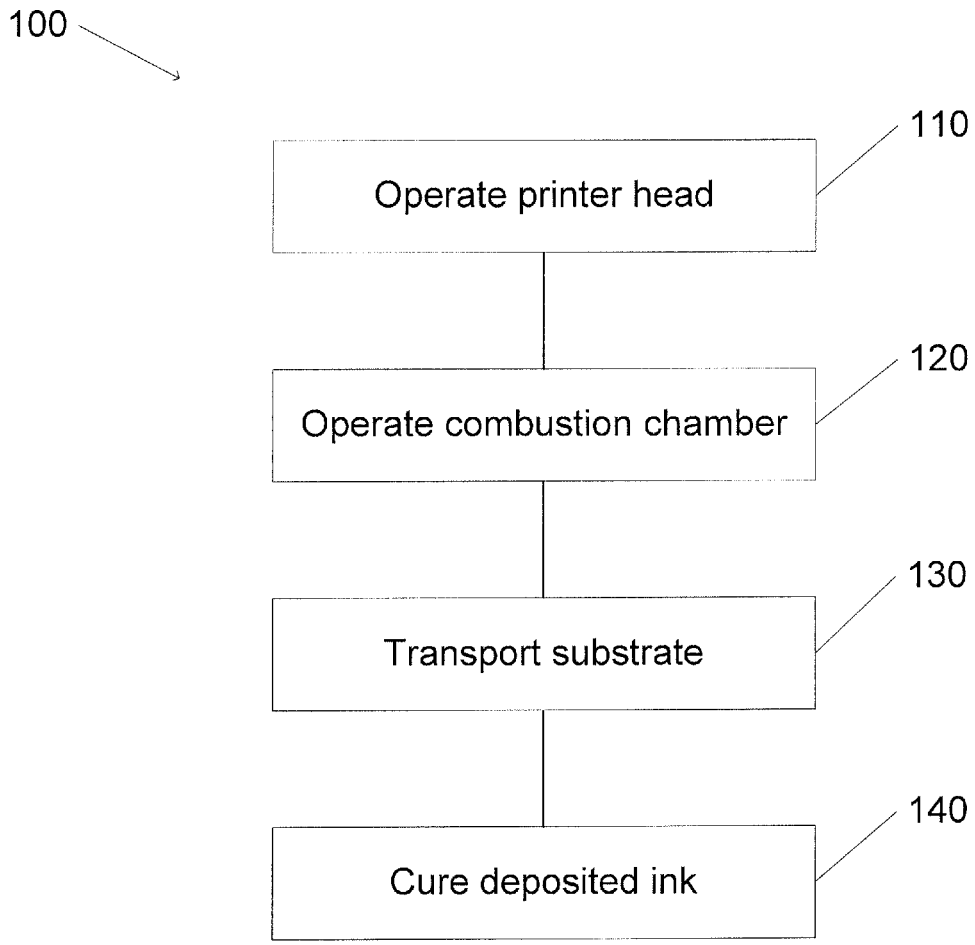
FIG. 3 is a flowchart depicting an example of a method of controlling a printing system, according to one example.

FIG. 3 is a flowchart depicting an example of a method for control of a printing system for application of an example of printed ink curing.

Printer control method 100 may be executed by a processor of a controller of printer system for application of an example of printed ink curing. Printer control method 100 may be executed upon a request or command that is issued by a user, or automatically issued by another application.

It should be understood with respect to the flowchart that the division of the illustrated method into discrete operations represented by blocks of the flowchart has been selected for convenience and clarity only. Alternative division of the illustrated method into discrete operations is possible with equivalent results. Such alternative division of the illustrated method into discrete operations should be understood as representing other examples of the illustrated method.

Similarly, it should be understood that, unless indicated otherwise, the illustrated order of execution of the operations represented by blocks of the flowchart has been selected for convenience and clarity only. Operations of the illustrated method may be executed in an alternative order, or concurrently, with equivalent results. Such reordering of operations of the illustrated method should be understood as representing other examples of the illustrated method.

In accordance with an example of controlling a printer system for printed ink curing, a computer program application stored in a computer-readable medium (e.g., register memory, processor cache, RAM, ROM, hard drive, flash memory, CD ROM, magnetic media, etc.) may include code or executable instructions that when executed may instruct or cause a controller or processor to perform methods discussed herein, such as an example of a method for controlling a printer system for printed ink curing. The computer-readable medium may be a non-transitory computer-readable media including all forms and types of computer-readable media except for a transitory, propagating signal.

Printer control method 100 includes operating a printhead of a printing system (block 110). Operating the printhead may include determining when ink has been deposited on a substrate by inkjet printing. In particular, operating the printhead may include determining when a curable ink, such as ultraviolet-curable ink, has been deposited on the substrate.

Printer control method 100 includes operating a combustion chamber (block 120). Operating the combustion chamber may include causing a combustible material to be combusted in the combustion chamber. Operating the combustion chamber may include controlling delivery of a combustion product to the curing chamber. Operating the combustion chamber may include monitoring production of a combustion product.

Printer control method 100 includes transporting the substrate relative to one or more components of the printing system (block 130). Transporting the substrate may include causing each region of the substrate on which ink had been deposited to be transported to the curing zone. Transporting the substrate may include moving one or more components of the printing system relative to the substrate. Transporting the substrate may include ensuring that the substrate is exposed to the curing agent for a sufficient period of time.

Printer control method 100 includes curing deposited ink, e.g. by operating one or more components of a curing zone (block 140). Curing may include operating a curing chamber. Curing may include forming an inert atmosphere in the curing zone. Forming the inert atmosphere may include controlling delivery and dispersal of one or more combustion products within the curing zone. Curing may include causing heat or heated gas to be delivered to the curing zone. Curing may include controlling application of a curing agent, such as operation of a lamp such as an ultraviolet lamp. Curing may include monitoring formation of the inert atmosphere, or of application of the curing agent.

We claim:

1. A printing system comprising:

a generator for in situ generation of a component of an inert atmosphere; and a curing zone in which the component is distributable over ink that had been deposited on a substrate, and in which is the ink is exposable to a curing agent, wherein the generator comprises a combustion chamber for burning a combustible material and wherein the component comprises a combustion product.

2. The system of claim 1, wherein the combustible material comprises propane or butane.

3. The system of claim 1, wherein the component comprises carbon dioxide or water.

4. The system of claim 1, comprising a separator for separating one combustion product from another.

5. The system of claim 4, configured such that one of the separated combustion is distributed in the curing zone separately from the other.

6. The system of claim 1, configured to distribute in the curing zone a gas that had been heated by heat produced by burning of the combustible material.

7. The system of claim 1, wherein the curing agent comprises radiation.

8. The system of claim 7, wherein the radiation comprises ultraviolet radiation.

9. The system of claim 8, comprising an ultraviolet lamp for generation of the ultraviolet radiation.

10. The system of claim 1, comprising a printhead for depositing the ink on the substrate.

11. A method comprising:

generating a component of an inert atmosphere within a generator of a printing system;

distributing the generated component on curable ink that had been deposited on a substrate; and applying a curing agent to the ink, wherein generating the component comprises burning a combustible material.

12. The method of claim 11, wherein distributing the component comprises distributing a combustion product of the burning of the combustible material.

13. The method of claim 11, wherein applying the curing agent comprises irradiating the ink with ultraviolet radiation.

* * * * *